US006826255B2

(12) United States Patent
Birdwell et al.

(10) Patent No.: US 6,826,255 B2
(45) Date of Patent: Nov. 30, 2004

(54) X-RAY INSPECTION SYSTEM AND METHOD OF OPERATING

(75) Inventors: Thomas William Birdwell, Middletown, OH (US); Forrest Frank Hopkins, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/400,177

(22) Filed: Mar. 26, 2003

(65) Prior Publication Data

US 2004/0190675 A1 Sep. 30, 2004

(51) Int. Cl.[7] ..... H01J 35/30
(52) U.S. Cl. ..... 378/137; 378/125
(58) Field of Search ..... 378/137, 125, 378/98.8; 250/370.09

(56) References Cited

U.S. PATENT DOCUMENTS 2,335,014 A 11/1943 Kerst
2,394,070 A 2/1946 Kerst
3,822,410 A 7/1974 Madey
4,408,338 A 10/1983 Grobman
4,926,452 A * 5/1990 Baker et al. ..... 378/22
6,151,381 A 11/2000 Grodzins et al.
6,167,110 A 12/2000 Possin et al.
6,487,274 B2 * 11/2002 Bertsche ..... 378/143

* cited by examiner

*Primary Examiner*—Craig E. Church
*Assistant Examiner*—Jurie Yun
(74) *Attorney, Agent, or Firm*—Adams Evans P.A.; V. G. Ramaswamy

(57) ABSTRACT

An X-ray inspection system is provided comprising an X-ray source which includes an electron gun and beam steering means for alternately directing the electron beam from the gun in a first direction wherein the beam strikes the anode to produce a beam of X-rays which exits the X-ray source, and in a second direction wherein no significant X-ray flux exits the X-ray source. An X-ray detector and means for reading the detector are also provided. The beam steering means and the detector reading means are coordinated so that the detector output is read during a period when no significant X-ray flux exits the source. A method for operating the X-ray inspection system is also provided.

12 Claims, 5 Drawing Sheets

X-RAY INSPECTION SYSTEM AND METHOD OF OPERATING

BACKGROUND OF THE INVENTION

This invention relates generally to X-ray inspection systems and more particularly to industrial X-ray systems which use digital detectors.

Recent advances in medical X-ray technology have provided a new generation of digital X-ray detectors, such as charge-coupled devices and amorphous silicon arrays, which have many advantages over traditional detection equipment and methods. These digital X-ray detectors are often adapted for use in industrial X-ray systems, which employ much greater voltage and energy than are typically used in medicine. One problem faced in using medical X-ray detectors to inspect industrial parts is that at these higher energies and corresponding voltages, the approaches used in medicine to control the X-ray source are not available on commercially available industrial X-ray sources.

X-ray tubes produce X-rays by accelerating electrons into a dense (generally tungsten) target. These tubes use electromagnetic or electrostatic steering methods to control the location of the electron beam impact on the target, and these methods consequently control the location and size of the X-ray focal spot. Several of the types of electronic detectors used in medical and industrial imaging either require that the X-ray flux be eliminated while the detector's signal is read and transferred to the downstream computing systems, or exhibit improvement in image quality if this is done. In lower voltage systems, i.e. less than about 225 KV, the X-ray tube's electron beam is controlled, starting and stopping the electron flow, effectively switching the tube's X-ray flux on and off in synchronization with the detector sampling period. The X-ray flux is created for a period of time during which X-ray photons penetrate the inspected object and then continue to the detector where they are counted or converted into measurable or accumulated charge. The X-ray flux is then turned off while the detector is read. As X-ray energies increase, it becomes increasingly difficult to accomplish this switching, and the commercial requirements for such industrial tubes decline in number. Methods such as simple tube grids that stop the tube's electron flow and other methods employed to pulse the electron beam are not available at higher tube voltages. When the X-ray flux can not be pulsed in this manner, image quality in electronic detector systems is degraded. This makes it difficult to employ these detector technologies in many industrial applications requiring higher energies. Furthermore, it is desirable to minimize the X-ray dose delivery to the detector to extend its lifetime. This is a constraint for certain equipment and for certain applications, and is becoming a larger issue with amorphous silicon detectors.

Accordingly, there is a need for a method of pulsing the X-ray flux in an industrial X-ray inspection system.

BRIEF SUMMARY OF THE INVENTION

The above-mentioned need is met by the present invention, which provides an X-ray inspection system comprising an X-ray source which includes an electron gun and beam steering means for alternately directing the electron beam from the gun in a first direction wherein the beam strikes the anode to produce a beam of X-rays which exits the X-ray source, and in a second direction wherein no significant X-ray flux exits the X-ray source. An X-ray detector and means for reading the detector are also provided. The beam steering means and the detector reading means are coordinated so that the detector output is read during a period when no significant X-ray flux exits the source. The present invention also provides a method for operating the X-ray inspection system.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
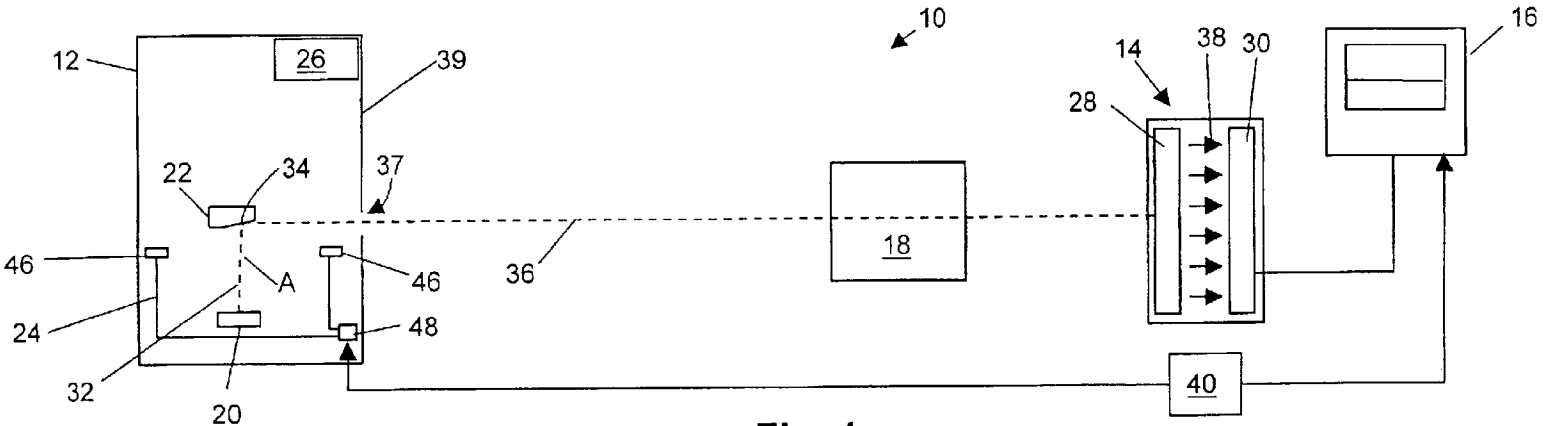
FIG. 1 is a schematic side view of an X-ray detection system constructed according to the present invention, in a condition wherein an X-ray flux is generated.
Figure 2:
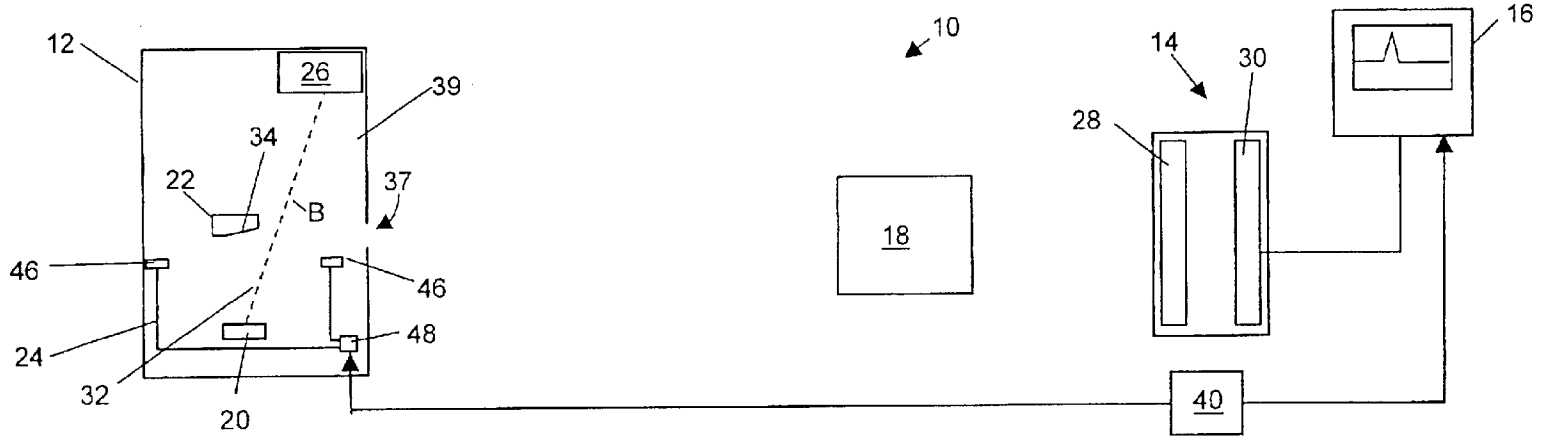
FIG. 2 is a schematic side view of the X-ray detection system of FIG. 1, in a condition wherein no significant X-ray flux is generated, or such flux is contained within the tube through the application of shielding

Referring to the drawings wherein identical reference numerals denote the same elements throughout the various views, FIGS. 1 and 2 illustrate an exemplary X-ray inspection system 10 constructed in accordance with the present invention. The inspection system 10 comprises an X-ray source 12, a detector 14, and a detector reading means 16. A part 18 to be inspected is disposed between the source 12 and the detector 14. The X-ray source 12 includes an electron gun 20 of a known type, an anode 22 of a dense material (such as tungsten) which emits X-rays when bombarded by electrons, and a beam steering means 24. The source 12 may also include a beam stop 26, described in more detail below. In the illustrated example, the detector 14 is of a known type such as a linear array detector or an amorphous silicon array detector, however the present invention may be applied to any electronic detector with the capability of periodic sampling that can be synchronized with the source 12. The detector 14 may comprise a plurality of adjacent detector elements arranged side-by-side or in a two-dimensional array, for example the detector 14 may be constructed in an arc shape (not shown) for use with a fan-shaped X-ray beam. The detector 14 is shown schematically as comprising a scintillator component 28 which produces optical photons when struck by ionizing radiation and a photoelectric component 30 such as a photodiode which produces an electrical signal when struck by optical photons. This electrical signal is the detector's output. Some types of detectors have an active layer that directly coverts x-ray flux to electric charge, and therefore do not require a scintillator. For purposes of illustration, an exemplary detector reading means 16 is depicted as a simple oscilloscope which displays a graphical representation of the signal output of the detector 14. It is to be understood that the detector reading means 16 may be any known device or combination of devices for displaying, measuring, storing, analyzing, or processing the signal from the detector 14, and that the term "reading" is intended to include any or all of the above-listed processes. In a typical computed tomography (CT) system or digital radiography (DR) system, the detector reading means 16 would comprise a sampling device (not shown) of a known type for receiving and storing the signals from the detector 14, for example an array of charge integrating amplifiers or an array of current to voltage amplifiers followed by an integrating stage. The sampling device is connected to separate means for processing and displaying an image constructed from the detector output, such as a computer and monitor. The detector reading means 16 and the beam steering means 24 are coordinated so that the output of the detector 14 is read during a period when no significant X-ray flux exits the X-ray source 12, as described in detail below.

FIG. 1 illustrates the X-ray inspection system 10 during a period when an X-ray flux is being generated. The electron gun 20 emits an electron beam 32 which travels in a first direction and strikes the anode 22 at a selected focal spot 34, as shown at "A". The beam steering means 24 may be used to focus the electron beam 32 and align it with the desired focal spot. In response, the anode 22 emits an X-ray beam 36 which exits through an aperture 37 in the housing 39 of the source 12. The X-ray flux when the beam is directed to the first position is at a nominal value. The nominal X-ray flux is determined by several variables, including but not limited to the voltage of the electron gun 20, the shape of the anode 22 and the material that it is constructed from, and the dimensions of the focal spot 34. The X-ray beam 36 then passes through the part 18, where it is attenuated to varying degrees depending on the density and structure of the part 18. The X-ray beam 36 then strikes the scintillator component 28 of the detector 14, which emits optical photons (shown schematically by arrows 38) that subsequently strike the photoelectric component 30 and cause a charge to build up therein.

Multi-element detectors are almost always read sequentially, through shared amplifiers. Since these are shared, continuing flux during the reading process results in the early read pixels having less flux at the time of reading than the later ones. Additionally, some devices like CCDs actually use charge shifting approaches, and continuing X-ray flux during these operations results in unwanted charge collection during the reading process. It also can increase noise in the system, since all electronics are somewhat subject to photon hits from stray X-rays. Accordingly, it is desirable to have the X-ray flux stopped or significantly minimized while reading the detector 14.

FIG. 2 illustrates the X-ray inspection system 10 during a period when an X-ray flux is not being generated. The electron gun 20 continues to emit an electron beam 32. However, in this condition, the beam steering means 24 direct the electron beam 32 in a second direction, depicted at "B" so that it strikes a location sufficiently different or distant from the focal spot 34 such that either reduced X-ray radiation is created, or so that the created X-rays are prevented from directly transiting to the part 18 being inspected by shielding or structure of the X-ray source 12. That is, no X-ray flux exits the aperture 37, or the flux exiting therefrom is reduced relative the nominal flux described above. The detector's output signal is read during this period. Ideally the X-ray flux during this period would be zero. Prior art non-pulsed applications make do with 100% of the nominal flux while the detector is read, and simply accept the increased difficulty in interpreting the output images. Preferably, with the present invention the X-ray flux is reduced to a significantly lower level from the nominal flux. The term "significantly lower level" is used to describe an X-ray flux low enough that the detector 14 may be read while the X-ray flux strikes it with noticeably improved image quality or ease of interpreting the image. More preferably the X-ray flux is reduced to about 10% or less of the nominal value, and most preferably it is reduced to about 1% of the nominal value or less.

The term "second direction" does not necessarily mean that the electron beam 32 is deflected at any specific angle or target location, but is generally used to describe the direction of the electron beam 32 any time it is directed far enough away from the focal spot 34 that the X-ray flux exiting the aperture 37 is reduced as described above. Because the electron beam 32 may be of significant energy, for example about 450 KV or more, the X-ray source 12 may incorporate a beam stop, examples of which are described below, which is capable of absorbing the electron beam's energy without damage or deterioration. The beam stop 26 ideally will be made of a material having a low atomic number. These materials produce fewer X-rays and the X-rays are lower in energy, and consequently easier to trap within the source 12 itself.

The X-ray inspection system 10 alternates between the conditions described above so that detector 14 and source 12 are pulsed in synchronization. For example, a controller 40 such as a known computer system may produce a control signal, such as a periodic series of pulses. Initially, there is no control signal pulse (i.e. the signal voltage is zero). The electron beam 32 is directed so that it strikes the anode 22 at the selected focal spot 34, creating an X-ray flux (i.e. X-ray beam 36) which exits the aperture 37, as described above.

When a control signal pulse begins (i.e. the signal voltage changes to a positive value), the beam steering means 24 are operated so that the electron beam 32 is directed to the position where substantially no X-ray flux exits the aperture 37, as described above. This steering function may be accomplished in different ways. For example if beam steering means 24 are used which have the capability to align and focus the electron beam 32 when the electron beam 32 is directed in the first direction, then the same beam steering means 24 could be operated in asymmetric fashion in order to deflect the electron beam 32 in the second direction. Alternatively, a simpler beam steering means such as a single deflection coil could be used, in which case the electron beam 32 would be deflected in the second direction any time the beam steering means 24 were energized. It is also possible to use external coils with commercially available tubes, as described in detail below. Simultaneously with the steering of the electron beam 32 in the second direction, the detector reading means 16 reads the detector output. For example, the beginning of the control signal pulse may be used as a trigger to cause a sampling device to begin storing the detector output signals.

When the control signal pulse stops (i.e. the signal voltage changes back to zero), the beam steering means 24 are redirected or de-energized and the electron beam 32 is again directed so that it strikes the anode 22 at the selected focal spot 34, creating an X-ray flux which exits the aperture 37. Simultaneously, the detector reading means 16 are turned off and the detector signal integration means turned on. For example, the end of the control signal pulse may be used as a trigger to cause the sampling device to stop recording the detector output signals. This cycle of electron beam movement is then repeated at a frequency compatible with the beam steering means 24 and the operating frequency of the detector 14, for example about 15 Hz to about 60 Hz, thereby providing a pulsed X-ray flux.

The operation of the pulsing function of the X-ray flux may be accomplished in a number of ways. A first exemplary configuration of an X-ray source 112 is illustrated in detail in FIG. 3. The X-ray source 112 includes a housing 39 which encloses the electron gun 20 and the anode 22. The housing 39 has an aperture 37 formed therein. The aperture 37 may be a simple opening or may be covered with a material transparent to X-rays. Beam steering means 24 are mounted in the housing 39 so as to be able to control the direction of the electron beam 32. For example, a plurality of electromagnetic deflection coils 46 of a known type, such as those used in electron-beam welding apparatus, may be mounted in the housing 39. In the illustrated example, first and second deflection coils 46 are mounted opposite each other along a line perpendicular to the electron beam 32, so as to be able to generate an electromagnetic field which deflect the electron beam 32 in a vertical plane. Additional deflection coils (not shown) may be used if it is desired to deflect the beam in other directions, or to focus the electron beam 32. The deflection coils 46 are connected to a source of current flow such as a coil power supply 48 of a known type. The electron beam 32 may also be steered by an electrostatic field created between a pair of deflection plates (not shown) connected to a power supply in a known manner.

In this embodiment, a stationary beam stop 60 is disposed in the housing 39. The beam stop 60 may be constructed of any material that stops the electron beam. The beam stop 60 is made of a material of low atomic number, such as graphite, which reduces the energy level and flux of the X-rays created when the electron beam 32 strikes it, as compared to a high-atomic number material. Graphite in particular has both a low atomic number and a high thermal conductivity. Additional examples of stopping materials with low atomic number include carbon—carbon reinforced composites, beryllium, and aluminum. One of the latter materials may be used to provide the beam stop 60 with greater structural integrity than graphite, where required. Magnesium could also be used. Because of these characteristics, it may be possible to use a graphite beam stop which is simply cooled by radiation without any other cooling provisions. In the illustrated example, the beam stop 60 comprises a layer of low-atomic-number material 61 which is backed up by a layer of dense material 63 (such as tungsten) to contain any X-ray radiation created at the secondary spot. When the electron beam 32 is deflected to the second direction, depicted at "B", it strikes the beam stop 60. The X-ray flux exiting the aperture 37 is greatly reduced because the electron beam 32 does not strike the focal spot 34 of the anode 22. The beam stop 60 may optionally be cooled to dissipate the heating from the electron beam 32. For example, the beam stop 60 may incorporate one or more circuits of internal cooling passages 62 through which a coolant is circulated.

Figure 4:
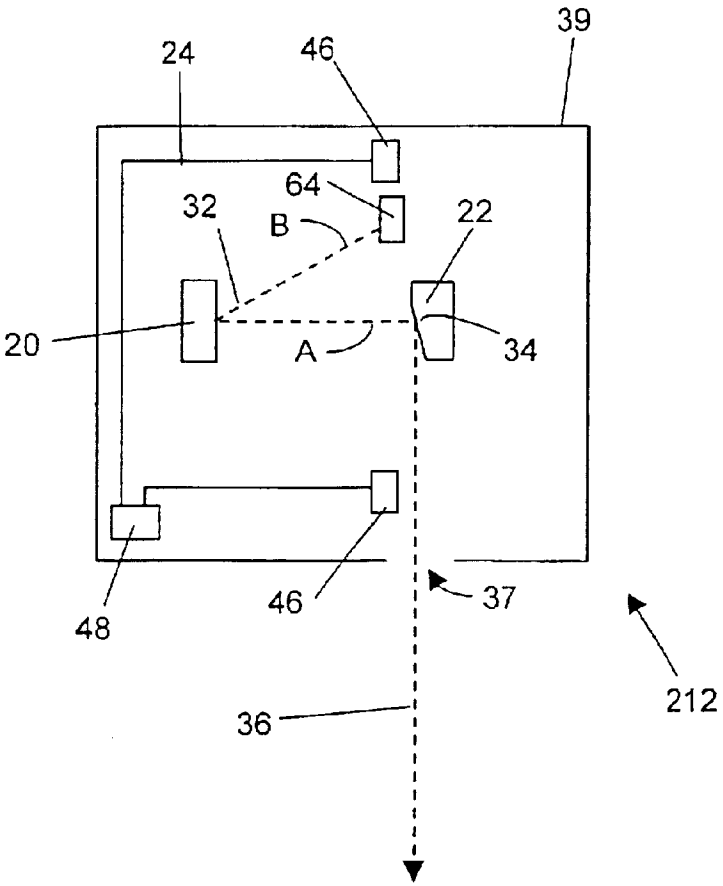
FIG. 4 is a schematic view of a second exemplary configuration of an X-ray source for use with the present invention.

A second exemplary configuration of the X-ray source 212 is illustrated in detail in FIG. 4. The X-ray source 212 again comprises a housing 39 which encloses an electron gun 20, an anode 22, and beam steering means 24 as described above. In this configuration, a stationary beam stop 64 is disposed in the housing 39, similar to the beam stop 60 illustrated in FIG. 3. The beam stop 64 in this configuration is located between the electron gun 20 and the face of the anode 22. When the electron beam 32 is deflected to the second direction, depicted at "B", it strikes the beam stop 64. The X-ray flux exiting the aperture 37 is greatly reduced from the nominal level because the electron beam 32 does not strike the focal spot 34 of the anode 22. This location of the beam stop 64 may permit the use of a smaller beam deflection or provide a more compact arrangement of the components inside the source 12.

Figure 3:
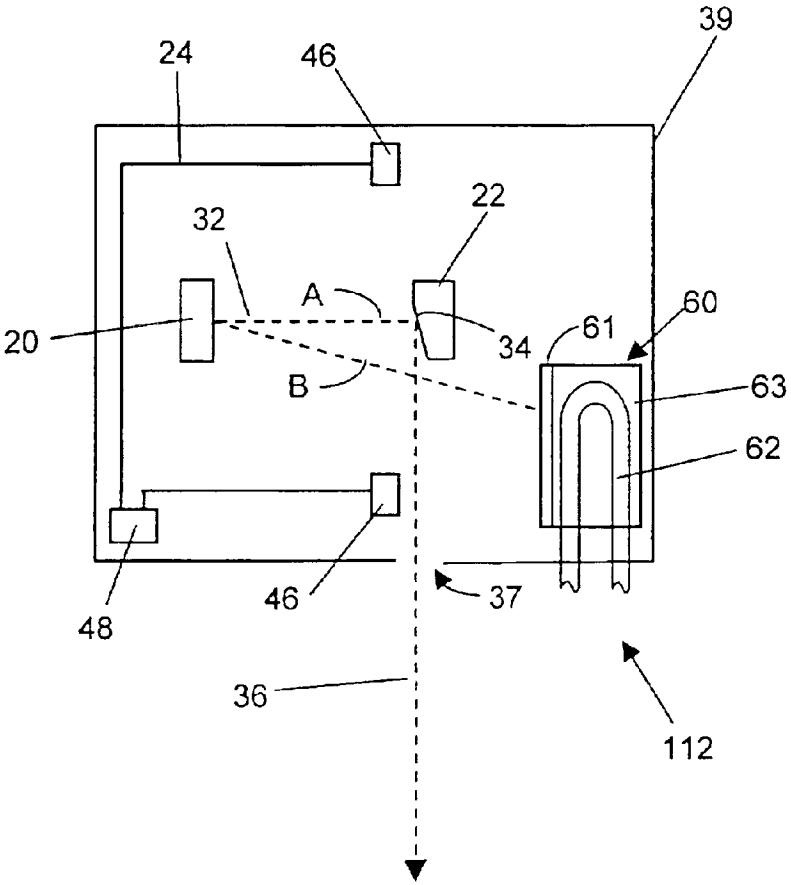
FIG. 3 is a schematic view of a first exemplary configuration of an X-ray source for use with the present invention.
Figure 5:
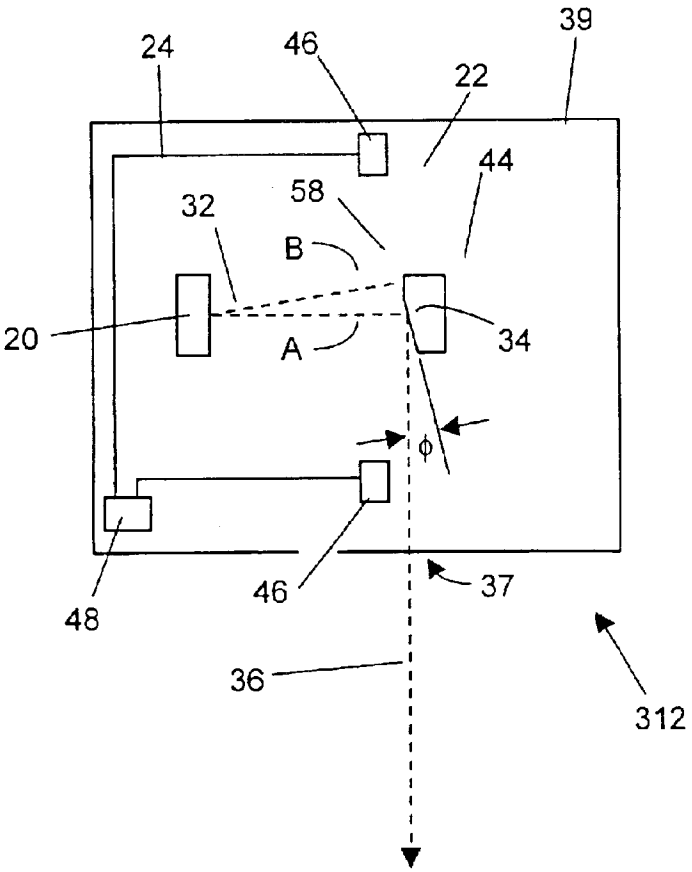
FIG. 5 is a schematic view of a third exemplary configuration of an X-ray source for use with the present invention.

A third exemplary configuration of an X-ray source 312 is illustrated in detail in FIG. 5. The X-ray source 312 again comprises a housing 39 which encloses an electron gun 20, an anode 22, and beam steering means 24, as depicted in FIG. 3. When the electron beam 32 is deflected to the second direction as described, it strikes the upper edge of the anode 22, as shown at "B". The X-ray flux exiting the aperture 37 is greatly reduced from the nominal level because the electron beam 32 does not strike the focal spot 34 of the anode 22.

Figure 7:
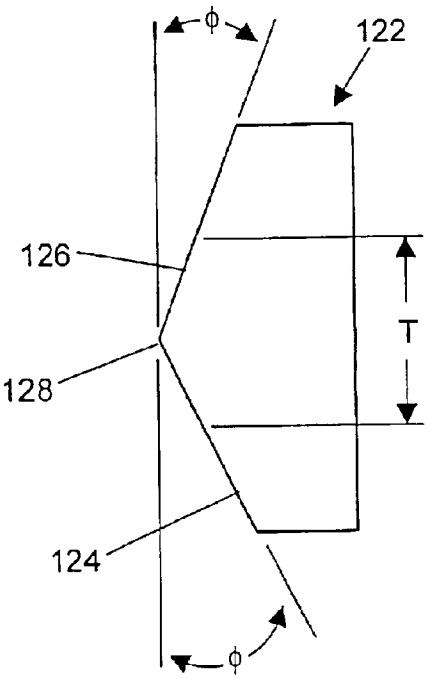
FIG. 7 is an enlarged view of the anode depicted in FIG. 6.
Figure 6:
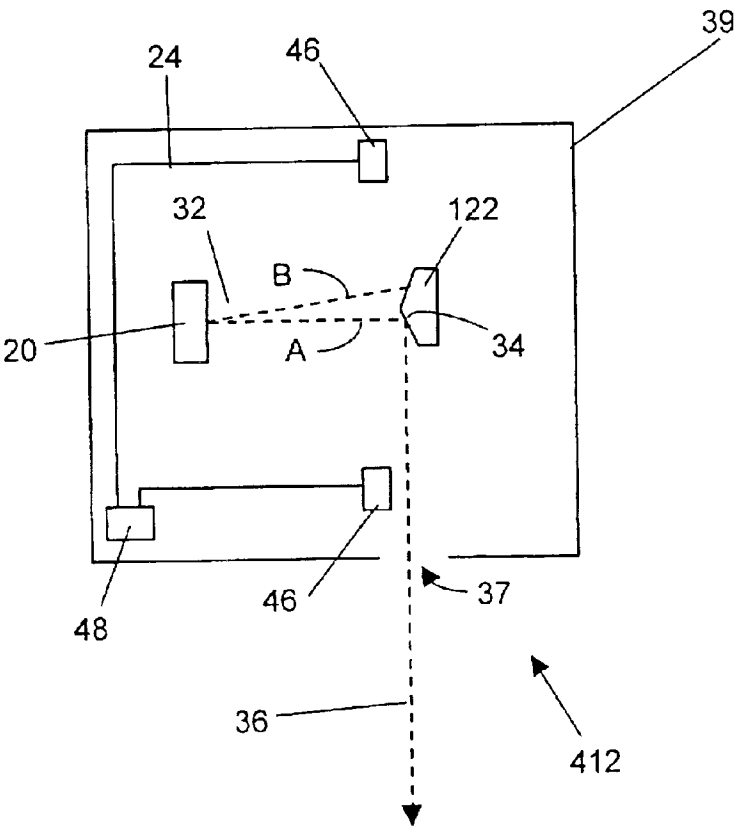
FIG. 6 is a schematic view of a fourth exemplary configuration of an X-ray source for use with the present invention.

A fourth exemplary configuration of an X-ray source 412 is illustrated in FIGS. 6 and 7. In each of the configurations previously described, the anode 22 has been shown as having a standard shape in which the surface containing the focal spot 34 is cut back at an angle $\phi$, illustrated in FIG. 5, referred to as a "heel angle", which can range from about 6° to about 30° with the vertical, depending upon the voltage, the stopping material, and the application. In a typical high energy conventional industrial X-ray tube, the angle $\phi$ is about 27°. In the configuration of FIGS. 6 and 7, a modified anode 122 has a first surface 124 angled at the heel angle, and is also provided with a second cut-back or angled surface 126. The surfaces 124 and 126 are both angled the same amount from the vertical in the illustrated example. The two angled surfaces meet to form a "V"-shape or point 128. When the electron beam 32 is deflected to the second position as described above, it strikes the second angled surface 126. Because of the modified anode's shape, the resulting X-rays have to transit an increased thickness T of the anode material, compared to the standard anode 22, in order to exit the aperture 37. The resulting attenuation within the modified anode 122 greatly reduces the X-ray flux through the aperture 37. This modified anode 122 may optionally be used with any of the X-ray source configurations described herein.

Figure 8:
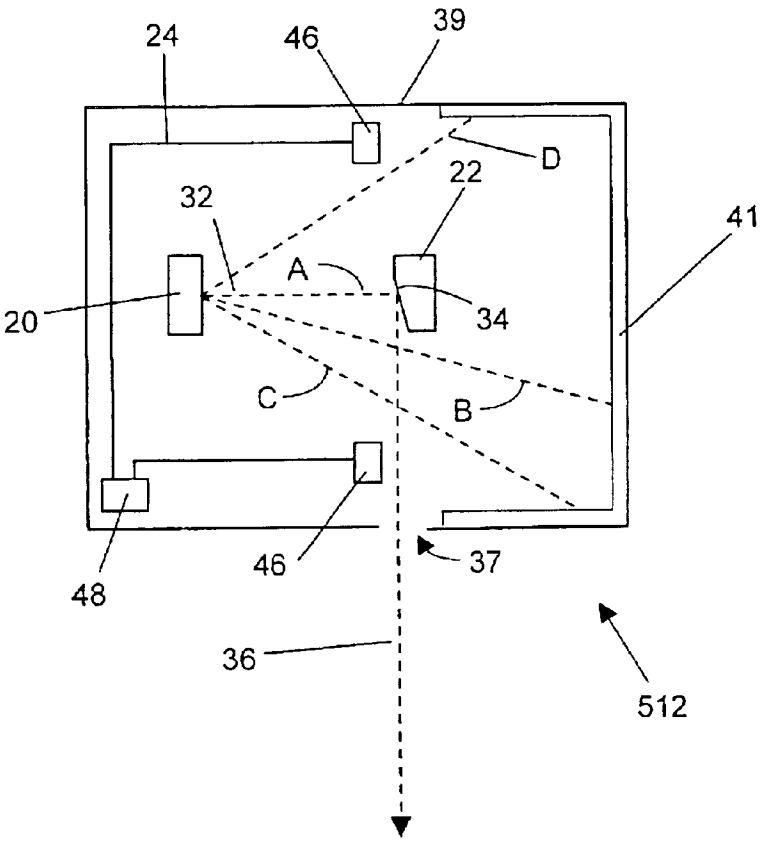
FIG. 8 is a schematic view of a fifth exemplary configuration of an X-ray source for use with the present invention.

A fifth exemplary configuration is shown in FIG. 8. The X-ray source 512 is generally similar to those described above. In this configuration, during a period when the X-ray flux is to be interrupted, the electron beam is steered around to varied locations away from the focal spot 34 in the interior of the housing 39, as shown at "B", "C", and "D". The electron beam 32 may be directed to discrete positions in a sequential manner, or it may be steered in a continuous sweeping fashion. In either case, the heat input to any particular location of the interior of the housing 39 is reduced. This method of steering the electron beam 32 may be used in lieu of having a separate beam stop. In conjunction with this method, the housing 39 may optionally be provided with a lining 41 in the form of a surface layer over the portions of its surface that the electron beam 32 is likely to strike while is it being steered. A material of low atomic number such as graphite or other material described above may be used to make the lining 41. The use of low atomic number material reduces the flux and the energy level of the emitted X-rays. Graphite is particularly useful as a material for the lining 41 as it has both a low atomic number and high thermal conductivity. This lining is and alternative which improves the containment of X-ray radiation within the housing 39 without requiring heavy shielding. As an example, the lining 41 may be made from a graphite layer a few centimeters in thickness, for example approximately 1–3 cm (0.4–1.2 in.) thick.

Figure 9:
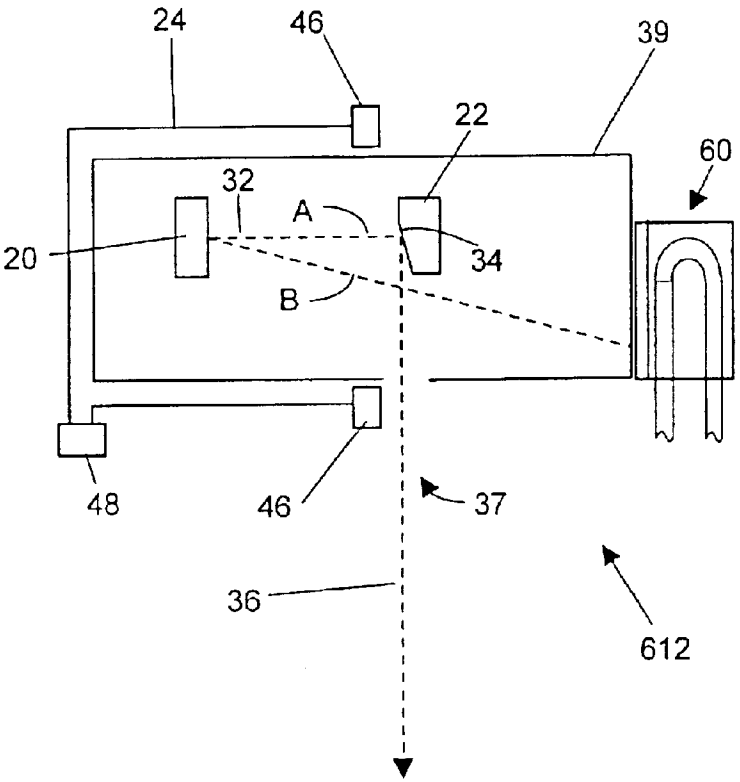
FIG. 9 is a schematic view of a an X-ray source having external deflection coils.

It is also possible to implement the present invention using commercially available X-ray tubes in combination with external coils. An example of this configuration is depicted in FIG. 9. The X-ray source 612 again comprises a housing 39 which encloses an electron gun 20 and an anode 22. Beam steering means 24 are mounted outside of the housing 29. In the illustrated example, the beam steering means comprise first and second deflection coils 46 mounted outside the housing, which are connected to a source of current flow such as a coil power supply 48 of a known type. The external coils 46 may be used to simply steer the electron beam 32 away from the focal spot 34 when it is desired to interrupt the X-ray flux, or optionally an external beam stop 60 may be mounted outside the housing 39 in line with the deflected position of the electron beam 32. This configuration offers the advantage that the basic X-ray tube itself does not have to be specially made or modified.

Figure 10:
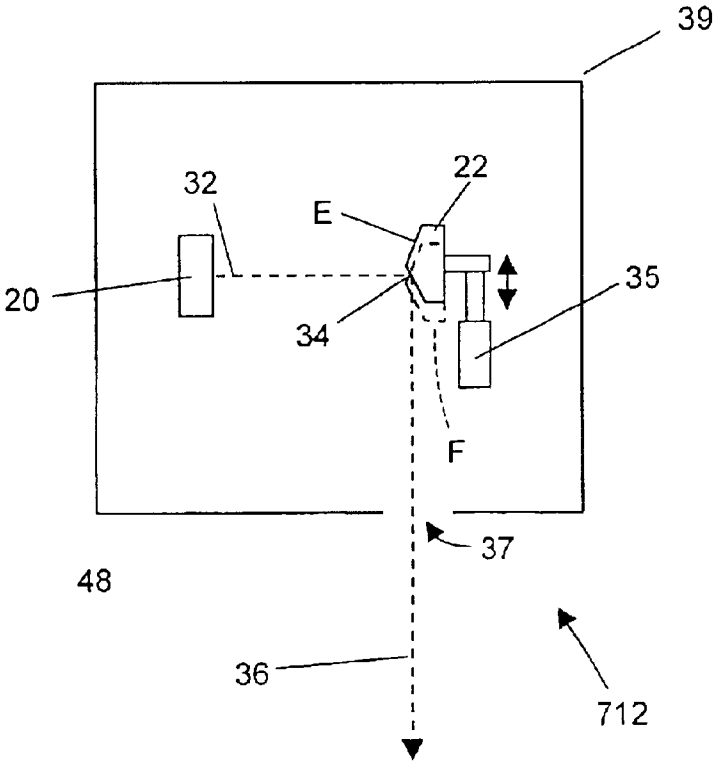
FIG. 10 is a schematic view of a exemplary X-ray source having a moving anode for use with the present invention.

Each of the exemplary configurations described above has described an X-ray source have a stationary anode and a moving electron beam. However, it is also possible to implement the present invention by providing an X-ray source having a stationary beam and moving the anode 22 to pulse the X-ray flux. An example of this is shown in FIG. 10. The X-ray source 712 includes a housing 39 enclosing an electron gun 20 and an anode 22. The anode 22 is mounted to an actuator 35. In the illustrated example, the actuator 35 is depicted as a rectilinear actuator, for example a servohydraulic cylinder. Other known types of actuators may be used, for example a linear electric motor, or even a rotary motor connected to a crank or cam mechanism. The actuator 35 is capable of moving the anode 22 at the desired detector sampling frequency. When the anode 22 is a first position, indicated at "E", the electron beam 32 from the electron gun 20 strikes the focal spot 34 and a beam 36 of X-rays exits the aperture 37. When it is desired to interrupt the X-ray flux, the anode 22 is moved to a second position as shown at "F". In this position, the electron beam 32 strikes the surface of the anode 22 opposite the focal spot 34, and accordingly the X-ray flux exiting the aperture 37 is eliminated or greatly reduced relative to the nominal output. The range of motion could also be sufficient that the anode 22 is moved completely out of the path of the electron beam at position "B". The actuator 35 is controlled in a known manner so as to move the anode 22 alternately between positions "E" and "F" at the desired frequency.

The foregoing has described an X-ray inspection system comprising an X-ray source which includes an electron gun and beam steering means for alternately directing the electron beam from the gun in a first direction wherein the beam strikes the anode to produce a beam of X-rays which exits the X-ray source, and in a second direction wherein no significant X-ray flux exits the X-ray source. An X-ray detector and means for reading the detector are also provided. The beam steering means and the detector reading means are coordinated so that the detector output is read during a period when no significant X-ray flux exits the source. A method for operating the X-ray inspection system has also been described. While specific embodiments of the present invention have been described, it will be apparent to those skilled in the art that various modifications thereto can be made without departing from the spirit and scope of the invention as defined in the appended claims.

What is claimed is:

1. An X-ray source, comprising: a housing; an electron gun for producing an electron beam; a anode comprising a material for producing X-rays when struck by said beam of electrons; and means for alternately directing said electron beam in a first direction wherein said electron beam strikes said anode so as to produce a beam of X-rays having a nominal flux, and in a second direction wherein said X-ray flux is reduced relative to said nominal flux; and a beam stop for receiving said electron beam while said beam is directed in said second direction, said beam stop comprising a first layer of a material of low atomic number, and a layer of a dense material disposed adjacent said first layer.

2. The X-ray source of claim 1 wherein said first layer comprises graphite.

3. The X-ray source of claim 1 further comprising means for cooling said beam stop.

4. The X-ray source of claim 1 wherein said means for directing said electron beam include means for generating at least one electromagnetic field.

5. The X-ray source of claim 4 wherein said at least one magnetic field is generated by at least one deflection coil.

6. The X-ray source of claim 5 wherein said at least one deflection coil is disposed outside said housing.

7. The X-ray source of claim 1 wherein said means for directing said electron beam include means for generating at least one electrostatic field.

8. The X-ray source of claim 7 wherein said at least one electrostatic field is generated by at least one pair of deflection plates.

9. The X-ray source of claim 8 wherein said deflection plates are disposed outside said housing.

10. The X-ray source of claim 1, wherein said anode includes a first surface disposed at a first angle, and a second surface disposed at a second angle, and said first and second surfaces intersect to form a "V" shape in cross-section.

11. The X-ray source of claim 1 wherein said electron beam is directed towards said housing in said second direction and wherein a lining of a low-atomic-number material disposed on the interior of said housing.

12. The X-ray source of claim 11 wherein said lining comprises graphite.

* * * * *